US010792941B2

(12) United States Patent
Shintani

(10) Patent No.: US 10,792,941 B2
(45) Date of Patent: Oct. 6, 2020

(54) WINDING APPARATUS AND PRINTING APPARATUS

(71) Applicant: SEIKO EPSON CORPORATION, Tokyo (JP)

(72) Inventor: Akihiro Shintani, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/368,395

(22) Filed: Mar. 28, 2019

(65) Prior Publication Data

US 2019/0299678 A1 Oct. 3, 2019

(30) Foreign Application Priority Data

Mar. 30, 2018 (JP) ..... 2018-066430

(51) Int. Cl.
*B41J 15/16* (2006.01)
*B65H 18/10* (2006.01)

(52) U.S. Cl.
CPC ..... *B41J 15/16* (2013.01); *B65H 18/10* (2013.01)

(58) Field of Classification Search
CPC ..... B65H 18/10; B41J 15/16
See application file for complete search history.

(56) References Cited

U.S. PATENT DOCUMENTS

| | | | | |
|---|---|---|---|---|
| 9,440,813 | B2 | 9/2016 | Kawajiri et al. | |
| 10,093,501 | B2 | 10/2018 | Kawajiri et al. | |
| 10,479,633 | B2 | 11/2019 | Kawajiri et al. | |
| 2015/0174933 | A1* | 6/2015 | Kawajiri | B65H 54/585 347/104 |
| 2015/0273881 | A1* | 10/2015 | Momose | B41J 3/4078 347/102 |
| 2016/0347566 | A1 | 12/2016 | Kawajiri et al. | |
| 2018/0354735 | A1 | 12/2018 | Kawajiri et al. | |

FOREIGN PATENT DOCUMENTS

| | | | |
|---|---|---|---|
| CN | 104724530 | A | 6/2015 |
| CN | 205274892 | U | 6/2016 |
| JP | 2015-134686 | A | 7/2015 |

* cited by examiner

*Primary Examiner* — Lamson D Nguyen
(74) *Attorney, Agent, or Firm* — Oliff PLC

(57) ABSTRACT

A winding apparatus includes a winding core unit onto which a continuous medium is to be wound, the winding core unit having a notched portion having a shape in which a part of the winding core unit in a circumferential direction is cut out as viewed in an extending direction of the winding core unit, and a notch complementing unit to be detacheably inserted into the notched portion from one end portion side in the extending direction of the winding core unit, the notch complementing unit being configured to complement the notched portion.

5 Claims, 14 Drawing Sheets

WINDING APPARATUS AND PRINTING APPARATUS

BACKGROUND

1. Technical Field

The present invention relates to a winding apparatus for winding a continuous medium and a printing apparatus.

2. Related Art

Winding apparatuses for winding a continuous medium around a paper tube that is attached to a winding core section are known, for example, in JP-A-2015-134686.

The winding apparatus disclosed in JP-A-2015-134686 can also directly wind a continuous medium around the winding core section without the paper tube. Without the paper tube, however, it is not easy to remove the continuous medium that has been wound around the winding core section from the winding core section.

SUMMARY

An advantage of some aspects of the invention is to provide a winding apparatus that enables users to readily remove a continuous medium from a winding core section and a printing apparatus.

According to an aspect of the invention, a winding apparatus includes a winding core unit onto which a continuous medium is to be wound, the winding core unit having a notched portion having a shape in which a part of the winding core unit in a circumferential direction is cut out as viewed in an extending direction of the winding core unit, and a notch complementing unit to be detachably inserted into the notched portion from one end portion side in the extending direction of the winding core unit, the notch complementing unit being configured to complement the notched portion.

According to another aspect of the invention, a printing apparatus includes a printing unit configured to perform printing onto a continuous medium, a winding core unit onto which the continuous medium is to be wound, the winding core unit having a notched portion having a shape in which a part of the winding core unit in a circumferential direction is cut out as viewed in an extending direction of the winding core unit, and a notch complementing unit to be detachably inserted into the notched portion from one end portion side in the extending direction of the winding core unit, the notch complementing unit being configured to complement the notched portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
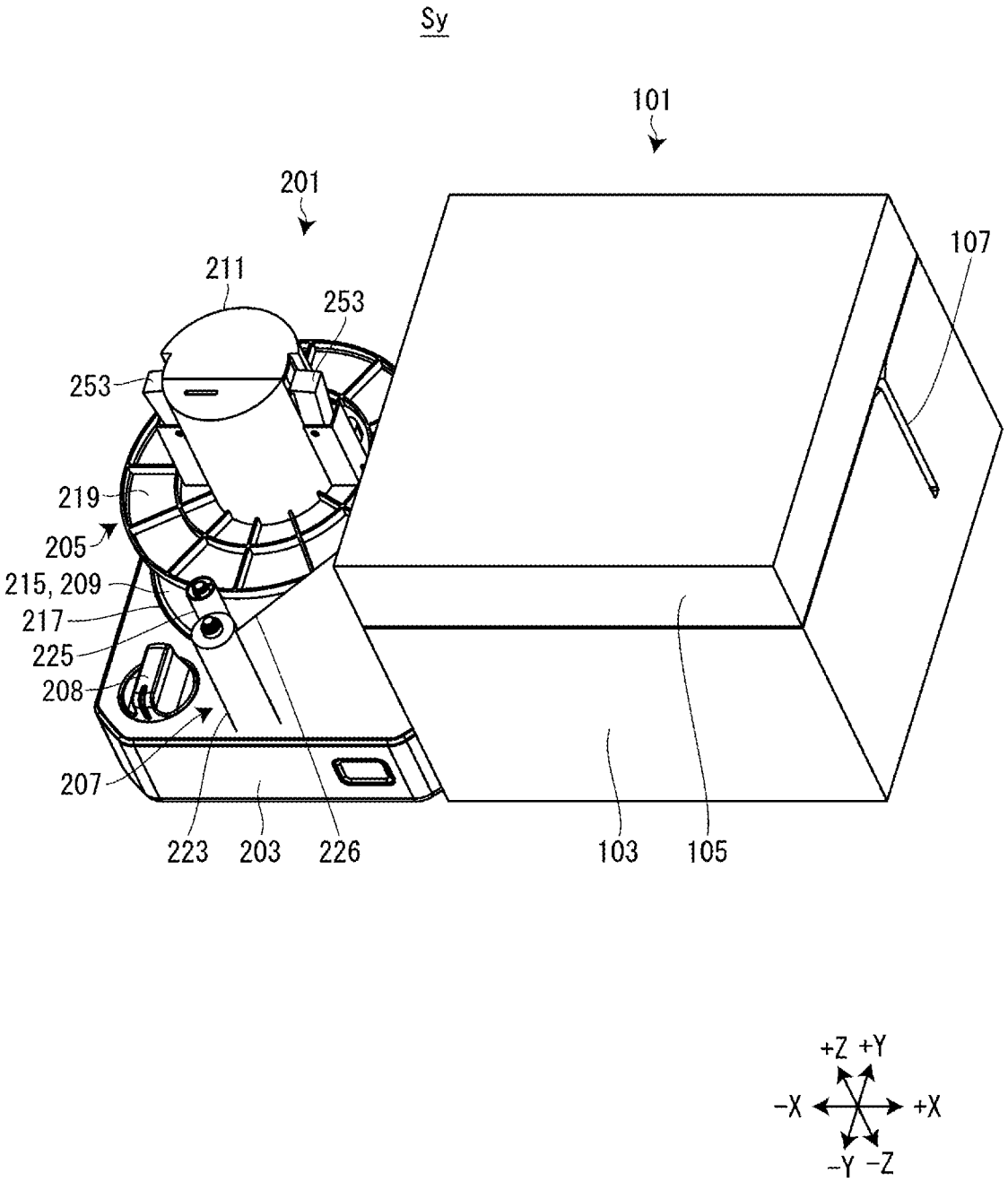
FIG. 1 is a perspective view illustrating a printing system that includes a tape printing apparatus and a winding apparatus according to an embodiment of the invention.

Hereinafter, an embodiment of a printing system that includes a tape printing apparatus and a winding apparatus will be described with reference to the attached drawings. To clarify an arrangement relationship of components, in the drawings described below, the XYZ coordinate system is provided, however, it should be understood that the system does not limit the invention. The numerical values indicating the number of components or the like are merely examples, and do not limit the invention.

Overview of Tape Printing Apparatus and Winding Apparatus

Figure 2:
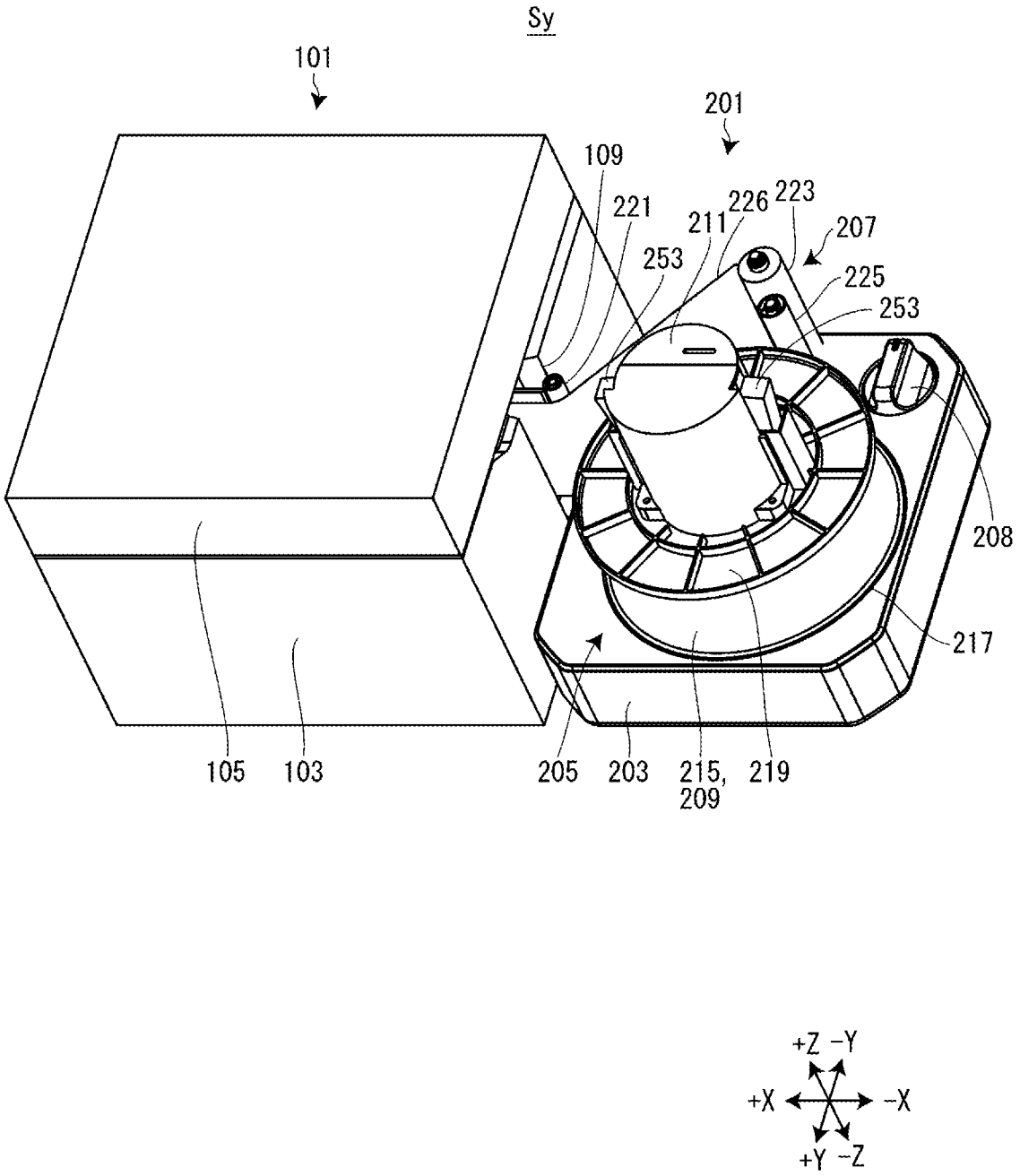
FIG. 2 is a perspective view illustrating the tape printing apparatus and the winding apparatus viewed from an angle different from FIG. 1.

With reference to FIG. 1 and FIG. 2, an overview of a tape printing apparatus 101 and a winding apparatus 201 in a printing system Sy will be described. The tape printing apparatus 101 performs printing onto a tape 401, see FIG. 3, and sends the printed tape 401 to the winding apparatus 201. The winding apparatus 201 winds the tape 401 sent from the tape printing apparatus 101. The tape 401 is an example "continuous medium" according to the invention.

The tape printing apparatus 101 includes an apparatus case 103 and an attachment section cover 105. The apparatus case 103 is a substantially rectangular parallelepiped. The apparatus case 103 has a tape introduction port 107 on the +X side and a tape discharge port 109 on the −X side. Into the tape introduction port 107, the tape 401 is introduced from the outside of the tape printing apparatus 101. The printed tape 401 is discharged from the tape discharge port 109. A cartridge attachment section that is not illustrated is provided on the +Z side of the apparatus case 103. The attachment section cover 105 is provided on the +Z side of the apparatus case 103 so as to be pivotable about an end portion on the +Y side. The attachment section cover 105 is used to open or close the cartridge attachment section. To the cartridge attachment section, a ribbon cartridge that is not illustrated that accommodates an ink ribbon is detachably attached.

Although not illustrated, in the apparatus case 103, a platen shaft, a thermal head, and a feed motor are provided. To the platen shaft, a platen roller is rotatably attached. When the feed motor is started, the platen roller rotates and the tape 401 and the ink ribbon held between the thermal head and the platen roller are sent. Then, the thermal head generates heat, and printing is performed onto the tape 401.

The winding apparatus 201 is disposed on the tape discharge port 109 side of the tape printing apparatus 101. The winding apparatus 201 includes a base section 203, a winding section 205, and a winding guide section 207.

The base section 203 is smaller in the Z direction than the apparatus case 103 of the tape printing apparatus 101 and has a substantially rectangular parallelepiped shape. On a surface on the +Z side of the base section 203, a dial 208 is rotatably provided. The user operates the dial 208 to adjust a position of the winding section 205 in the Z direction.

Onto the winding section 205, the tape 401 that has been sent from the tape printing apparatus 101 is wound. The winding section 205 includes a winding body 209 and a winding attachment body 211. The winding body 209 is rotatably provided on the surface on the +Z side of the base section 203. The winding attachment body 211 is detachably attached to the winding body 209 and rotates together with the winding body 209.

Figure 4:
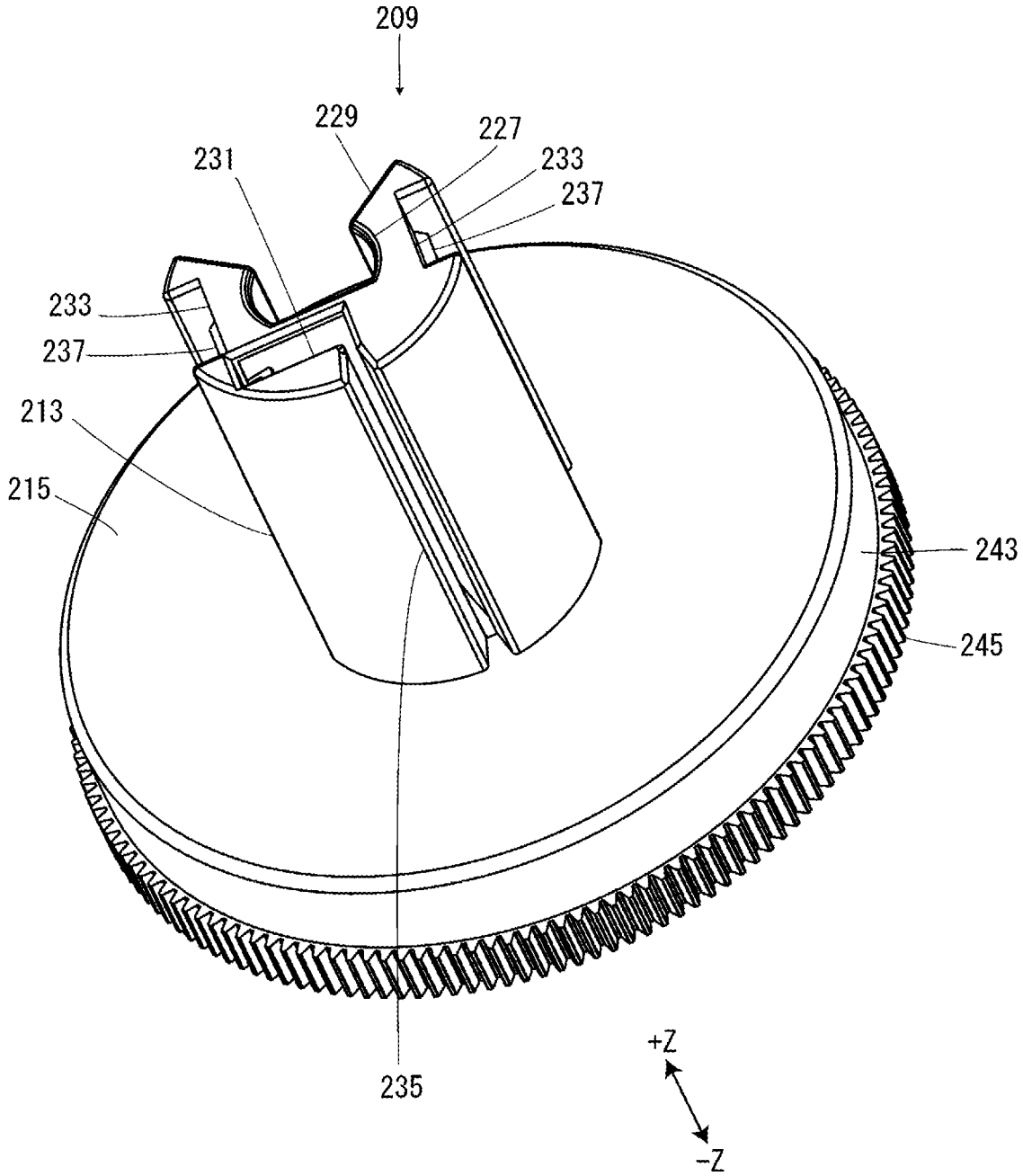
FIG. 4 is a perspective view illustrating a winding body.
Figure 5:
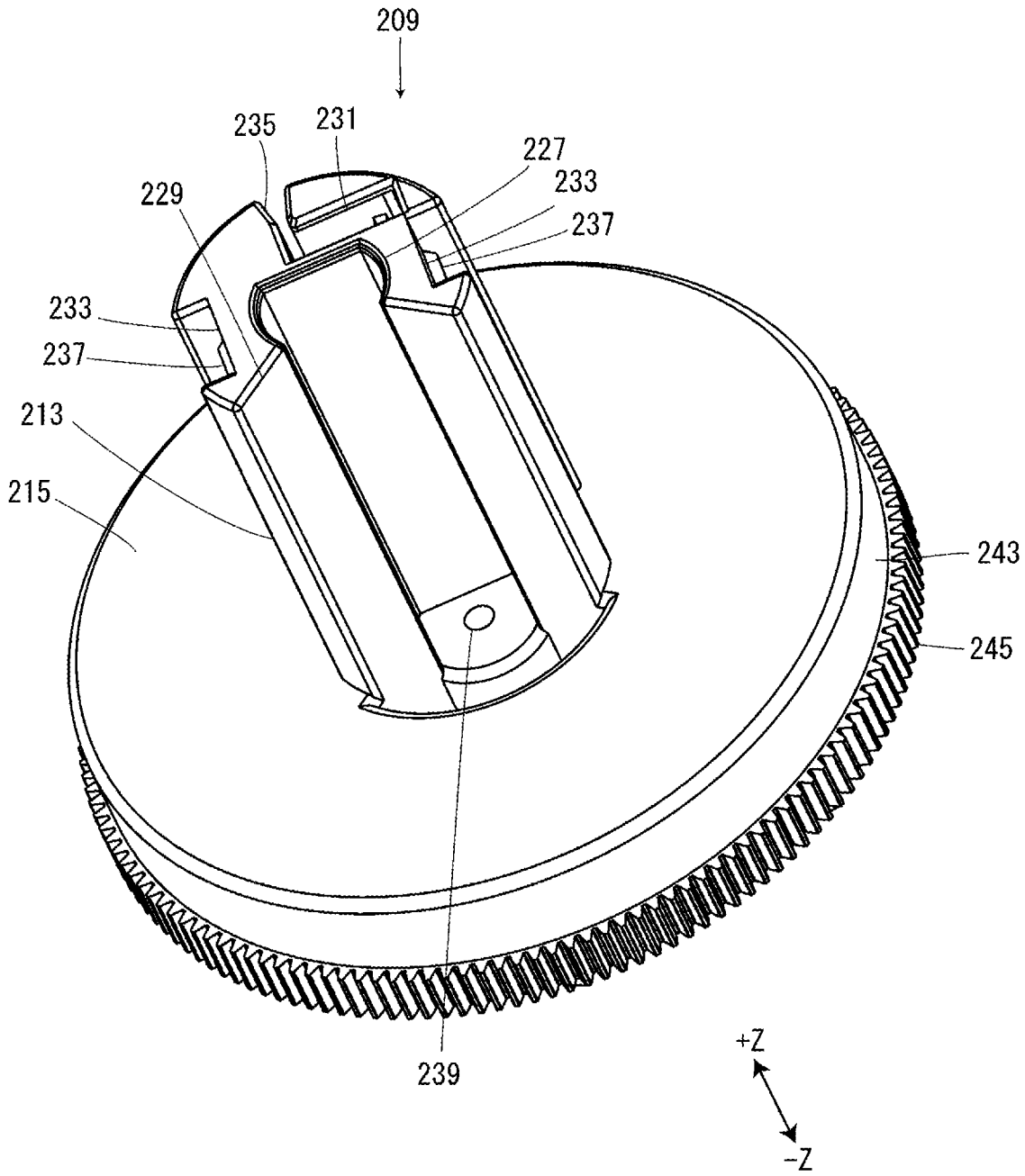
FIG. 5 is a perspective view illustrating the winding body viewed from an angle different from FIG. 4.
Figure 6:
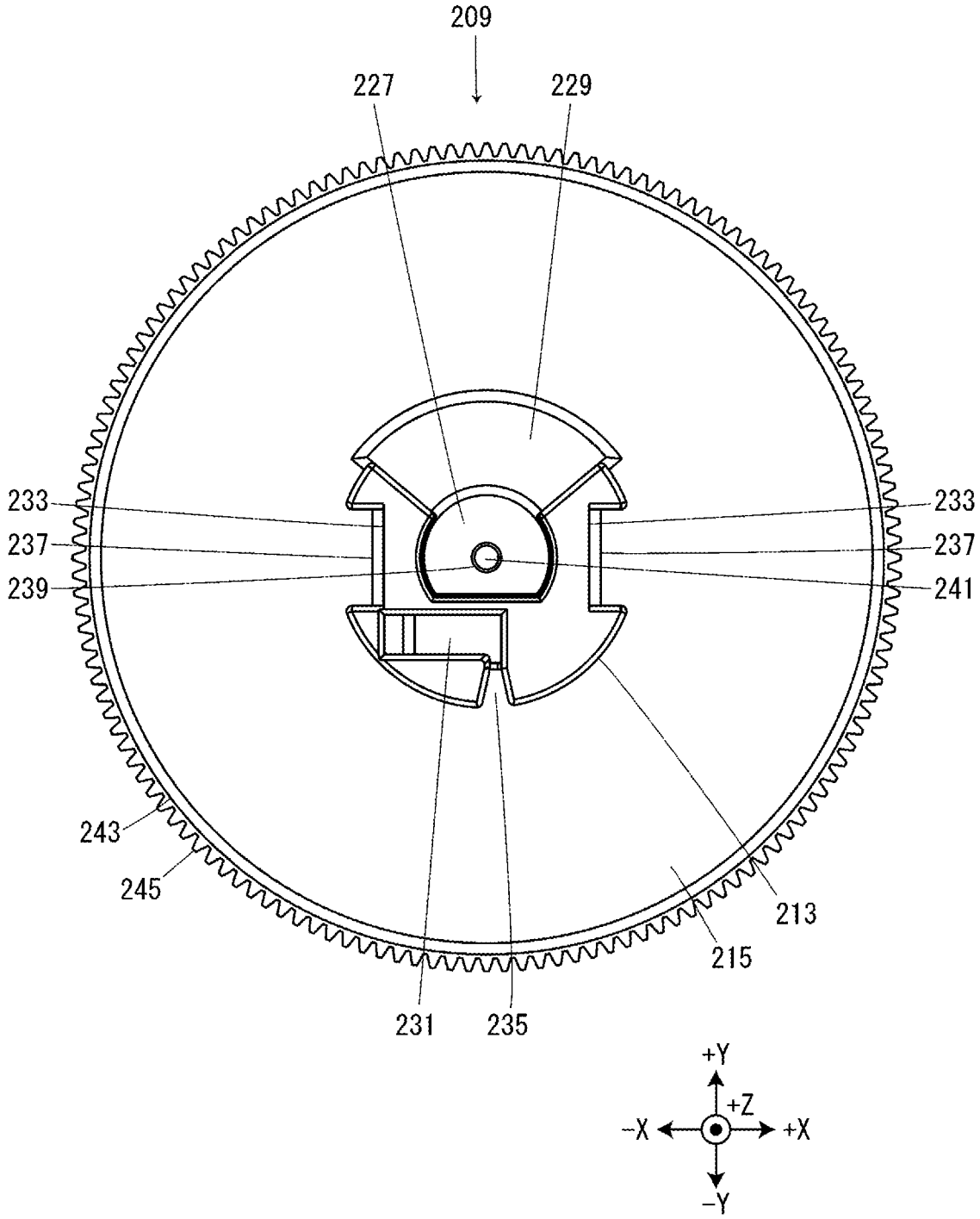
FIG. 6 illustrates the winding body viewed from a +Z side.

The winding body 209 includes a winding core section 213, see FIG. 4, and a first flange section 215. The winding body 209 is provided on the base section 203 such that the first flange section 215 is fit into a circular opening 217 that is provided on the surface on the +Z side of the base section 203. The winding attachment body 211 includes a second flange section 219. The first flange section 215 and the second flange section 219 have a substantially disc shape. The winding attachment body 211 is attached to the winding body 209 such that the second flange section 219 faces the first flange section 215. The tape 401 sent from the tape printing apparatus 101 is wound onto the winding core section 213 while being guided in the width direction of the tape 401 by the first flange section 215 and the second flange section 219. The second flange section 219 is an example "flange unit" according to the invention.

The winding guide section 207 is provided on the surface on the +Z side of the base section 203. The winding guide section 207 guides the tape 401 that is sent from the tape discharge port 109 of the tape printing apparatus 101 to the winding section 205. The winding guide section 207 includes a first guide roller 221, a friction member 223, a second guide roller 225, and a guide wall 226. The first guide roller 221 guides the tape 401 that is sent from the tape discharge port 109 to the friction member 223. The friction member 223 applies frictional resistance to the tape 401 such that the force to pull the tape 401 toward the winding section 205 is reduced. The second guide roller 225 guides the tape 401 that is sent from the friction member 223 to the winding section 205. The guide wall 226 suppresses the slack in the tape 401 toward the winding section 205 side while the tape 401 is sent from the first guide roller 221 to the friction member 223.

Tape

Figure 3:
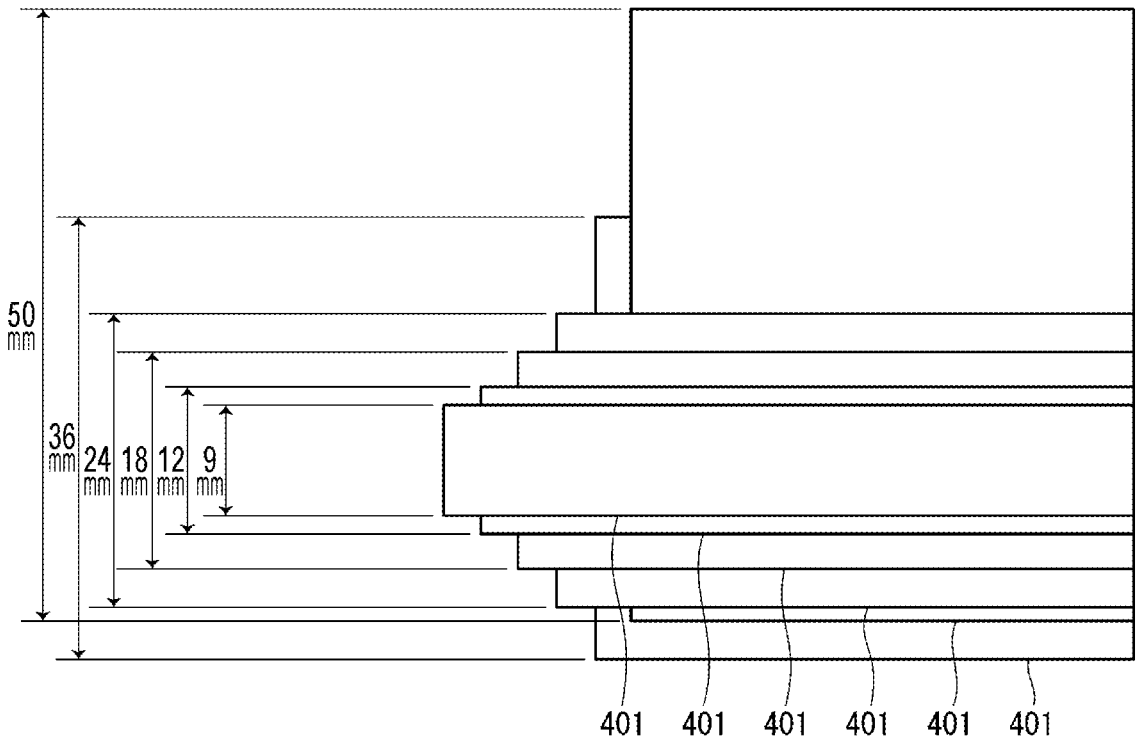
FIG. 3 illustrates tapes of different widths wound around a winding core section viewed in a direction orthogonal to a Z direction for comparison of positions of the tapes in the Z direction.

With reference to FIG. 3, the tape 401 will be described. A plurality of types of tape 401 having different widths, for example, six types of tape 401 of 9 mm, 12 mm, 18 mm, 24 mm, 36 mm, and 50 mm are available. Among the tapes, the four tapes 401 of 9 mm, 12 mm, 18 mm, and 24 mm are sent such that the respective central positions of the tapes 401 in the width direction are substantially the same in the tape printing apparatus 101. Accordingly, the positions of the both ends of the tapes 401 in the width direction are different from each other. The tapes 401 of 36 mm and 50 mm are sent such that the respective central positions of the tapes 401 in the width direction are different from the central positions of the other tapes 401 in the tape printing apparatus 101. Accordingly, the positions of the both ends of the tapes 401 of 36 mm and 50 mm in the width direction are different from the positions of the both ends of the other tapes 401.

Winding Body

With reference to FIGS. 4 to 7, the winding body 209 will be described. The winding body 209 includes the winding core section 213 and the first flange section 215 as described above.

The winding core section 213 has a substantially cylindrical shape and extends in the Z direction. The winding core section 213 has a rod insertion section 227, a notched section 229, a tape insertion section 231, and two engagement-section formed surfaces 233.

The rod insertion section 227 is provided at a substantially central portion in the winding core section 213 as viewed from the +Z side. The rod insertion section 227 is a space extending along the extending direction of the winding core section 213 and has a shape in which a part of a circle is linearly cut away as viewed from the +Z direction. When the winding attachment body 211 is attached to the winding body 209, into the rod insertion section 227, a rod section 255, see FIG. 8, of the winding attachment body 211 is inserted from the +Z side.

The notched section 229 is a space extending along the extending direction of the winding core section 213 and has a shape in which a part of the winding core section 213 in the circumferential direction is cut out in a substantially fan shape as viewed from the +Z direction. The notched section 229 is continuous with the rod insertion section 227 on a radially inner side as viewed from the +Z side. When the winding attachment body 211 is attached to the winding body 209, into the notched section 229, a notch complementing section 249, see FIG. 8, of the winding attachment body 211 is inserted from the +Z side.

The tape insertion section 231 is provided on the side opposite to the notched section 229 with respect to the rod insertion section 227 as viewed from the +Z side. The tape insertion section 231 is a space extending along the extending direction of the winding core section 213, and has a substantially rectangular shape as viewed from the +Z direction. On a circumferential surface of the winding core section 213, a slit-like tape insertion opening 235 that extends in the extending direction of the winding core section 213 is provided. The tape insertion opening 235 is continuous with one end portion of the tape insertion section 231 in a longitudinal direction as viewed from the +Z side. Hereinafter, the longitudinal direction of the tape insertion section 231 as viewed from the +Z side is simply referred to as "longitudinal direction of the tape insertion section 231", and a short side direction of the tape insertion section 231 as viewed from the +Z side is simply referred to as "short side direction of the tape insertion section 231".

Before winding the tape 401, the beginning of the tape 401 to be wound around the winding core section 213 is inserted into the tape insertion section 231 from the tape insertion opening 235 by the user. When the winding attachment body 211 is attached to the winding body 209, into the tape insertion section 231, a tape holding protrusion 271, see FIG. 13, of the winding attachment body 211 is inserted from the +Z side. The tape insertion section 231 is an example "medium insertion unit" according to the invention.

The two engagement-section formed surfaces 233 are positioned so as to be substantially symmetric with respect to points with the center of the winding core section 213 as the center of symmetry as viewed from the +Z side. In other words, each engagement-section formed surface 233 is provided between the notched section 229 and the tape insertion opening 235 in the circumferential direction of the winding core section 213 as viewed from the +Z side.

On each engagement-section formed surface 233, five core-side engagement sections 237 are provided along the extending direction of the winding core section 213. The five core-side engagement sections 237 are provided so as to correspond to the five tapes 401 having the widths from 12 mm to 50 mm. The core-side engagement section 237 is engaged with a lever-side engagement section 279, see FIG. 13, of a lever 253 that is provided in the winding attachment body 211. The engagement of the core-side engagement section 237 with the lever-side engagement section 279 enables the winding attachment body 211 to be attached to the winding body 209 at the position corresponding to the width of the tape 401.

The first flange section 215 is provided on an end portion of the winding core section 213 on the −Z side. The first flange section 215 and the winding core section 213 are integrally formed. At a central portion of the first flange section 215, a shaft insertion hole 239 is provided. In the shaft insertion hole 239, a winding shaft 241 that extends along the extending direction of the winding core section 213 is inserted. The winding body 209 is supported by the winding shaft 241 so as to be rotatable and movable in the extending direction of the winding shaft 241. The winding shaft 241 that is inserted in the shaft insertion hole 239 positions the first flange section 215 in a direction intersecting the extending direction of the winding shaft 241, that is, in the X direction and the Y direction. The winding shaft 241 is fixed to a winding-side support plate that is provided in the base section 203 and protrudes from the winding-side support plate toward the +Z side.

The first flange section 215 has a non-gear portion 243 on the +Z side and a flange gear portion 245 on the −Z side. The flange gear portion 245 meshes with an output gear that is not illustrated. To the output gear, the power of the feed motor in the tape printing apparatus 101 is transmitted. In other words, the winding section 205 is rotated by the feed motor as a drive source. Alternatively, the winding section 205 may be rotated by a motor in the winding apparatus 201 as a drive source.

Winding Attachment Body

Figure 8:
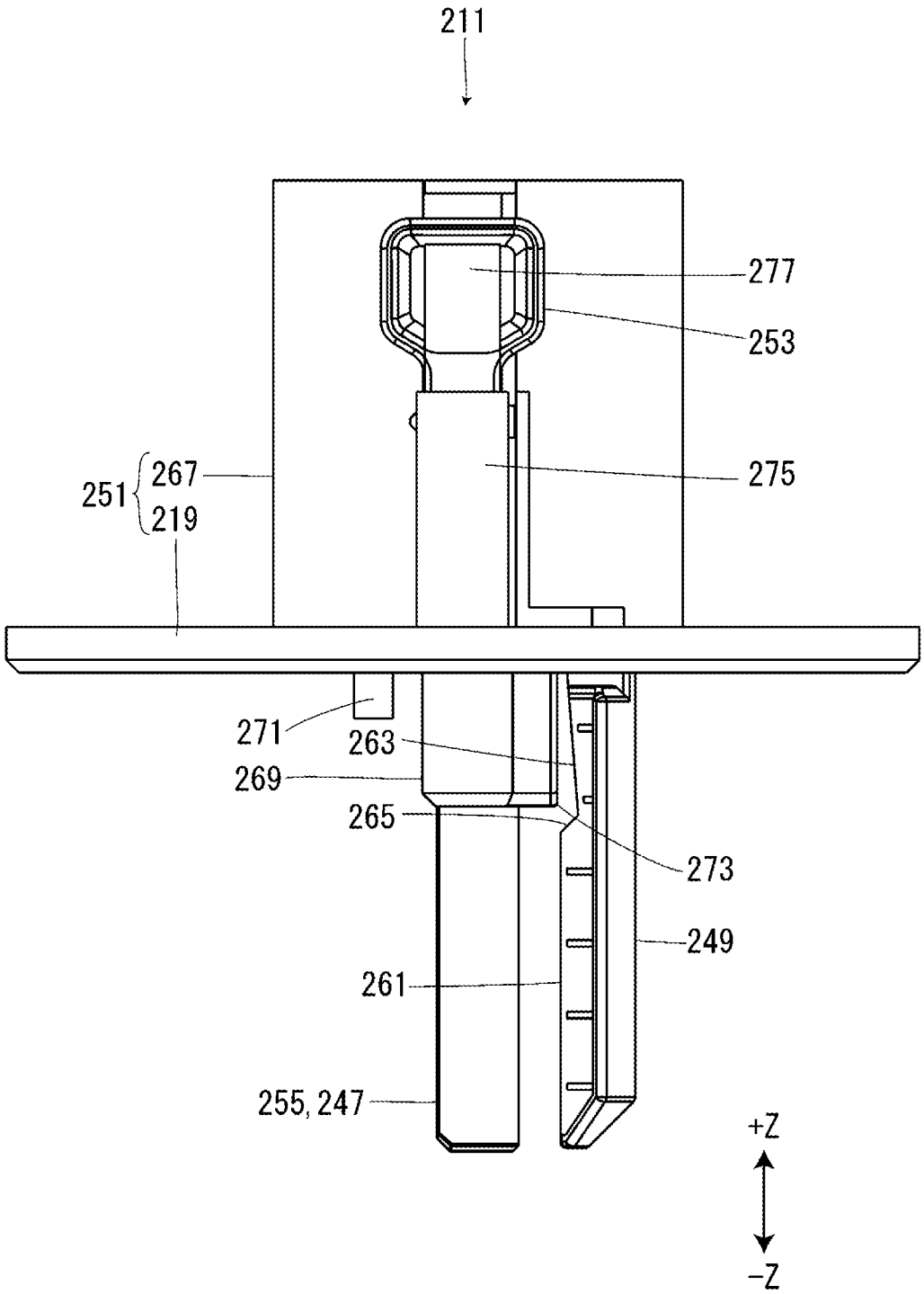
FIG. 8 illustrates a winding attachment section viewed in a direction orthogonal to the Z direction.

With reference to FIG. 8, the winding attachment body 211 will be described. The winding attachment body 211 includes a rod forming body 247, a notch complementing section 249, a flange forming body 251, and two levers 253. The flange forming body 251 is an example "flange forming unit".

Figure 9:
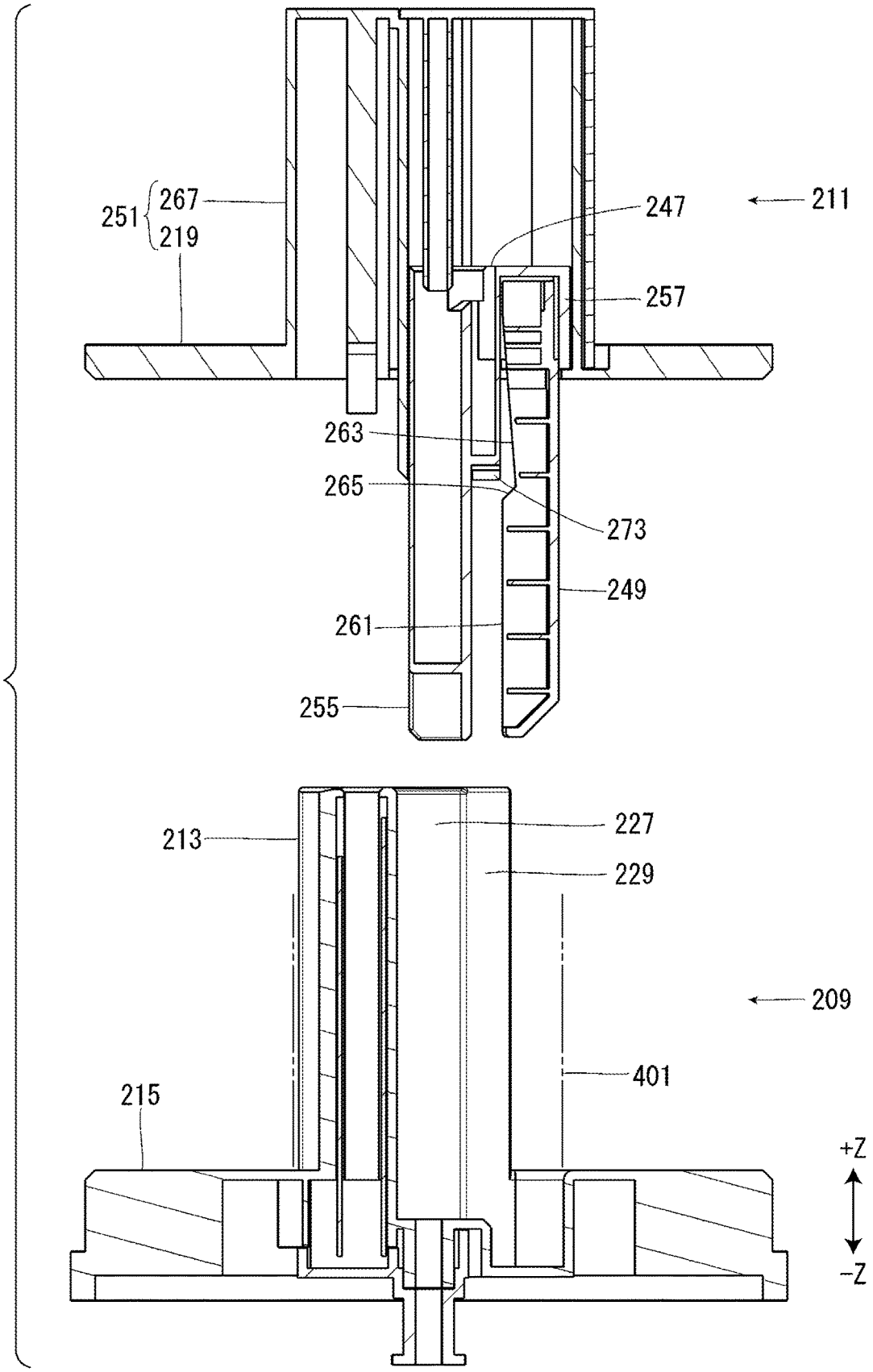
FIG. 9 is a cross-sectional view illustrating a winding body and a winding attachment section in which a rod section has not yet been inserted into a rod insertion section before winding is started.

The rod forming body 247 includes a rod section 255 and a complementary attachment section 257, see FIG. 9. The rod section 255 has a substantially cylindrical shape that extends in the extending direction of the winding core section 213. The rod section 255 is inserted into the rod insertion section 227 in the winding body 209 from the +Z side when the winding attachment body 211 is attached to the winding body 209. The complementary attachment section 257 is provided on a +Z side end portion of rod section 255. To the complementary attachment section 257, the notch complementing section 249 is attached.

The notch complementing section 249 has a substantially fan columnar shape that extends in the extending direction of the winding core section 213. Specifically, the notch complementing section 249 has a substantially fan shape similar to the shape of the notched section 229 as viewed from the +Z side, see FIG. 7. When the winding attachment body 211 is attached to the winding body 209, the notch complementing section 249 is detacheably inserted into the notched section 229 from the +Z side, that is, from one end portion side of the winding core section 213 in the extending direction so as to complement the notched section 229.

Figure 7:
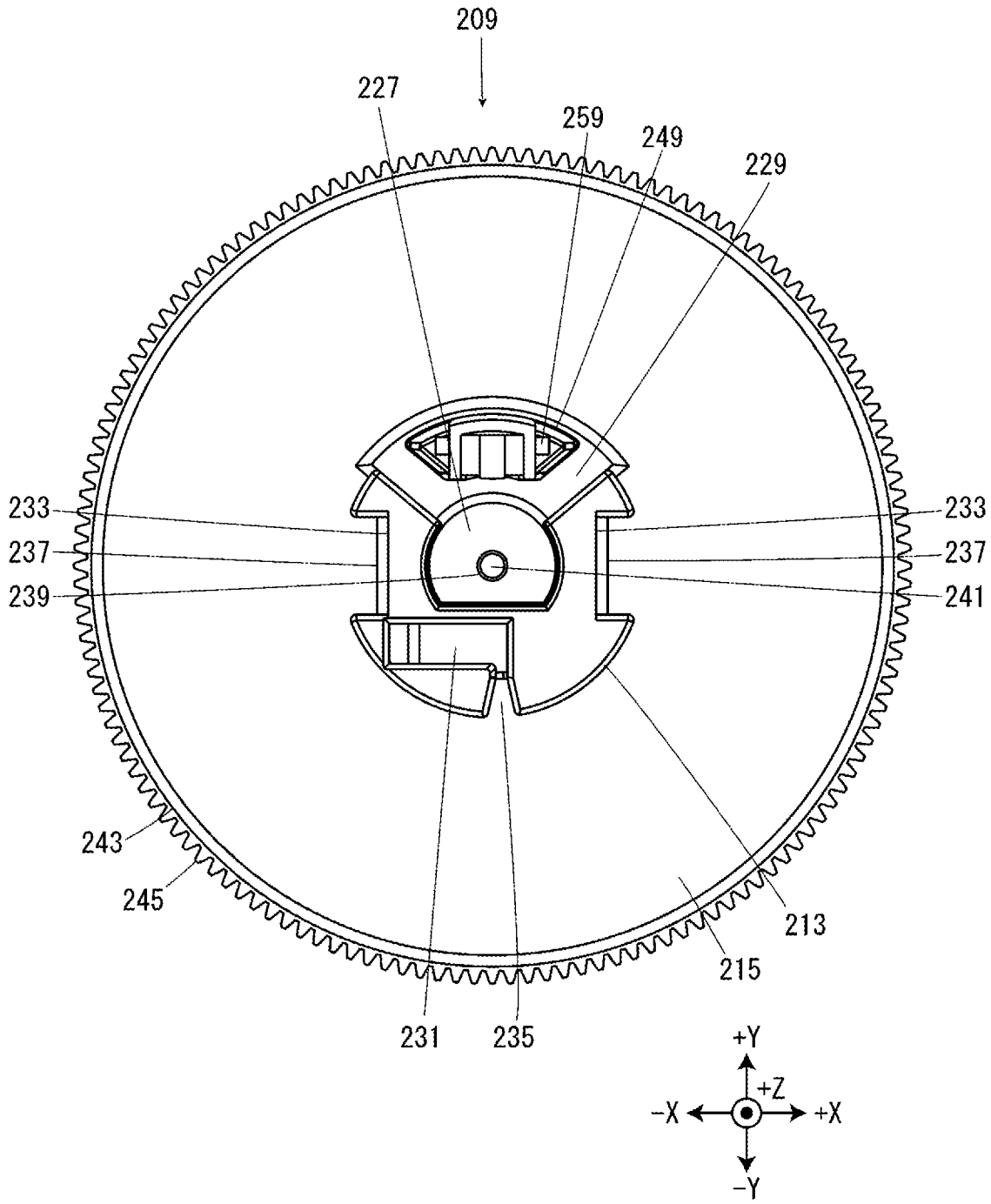
FIG. 7 illustrates a notch complementing section inserted into a notched portion of the winding body viewed from the +Z side.

A complementary shaft section 259, see FIG. 7, is provided to a +Z side end portion of the notch complementing section 249. The complementary shaft section 259 extends in a direction intersecting the extending direction of the winding core section 213. The notch complementing section 249 is attached to the complementary attachment section 257 so as to be able to rotate about the complementary shaft section 259. More specifically, the notch complementing section 249 is substantially parallel to the rod section 255 and can be rotated between a contact position, see FIG. 11, in which the notch complementing section 249 comes into contact with the tape 401 that has been wound around the winding core section 213 and a separated position, see FIG. 12, in which the notch complementing section 249 is separated from the tape 401 radially inward toward the winding core section 213.

To the complementary attachment section 257, a complementary spring that is not illustrated for applying a force to the notch complementing section 249 toward the contact position is provided. The complementary spring prevents the notch complementing section 249 from freely moving while the winding attachment body 211 is detached from the winding body 209. The complementary spring may be, for example, a compression coil spring.

The notch complementing section 249 has, on an inner side, a complementary convex portion 261 on the −Z side and a complementary concave portion 263 on the +Z side. The complementary convex portion 261 protrudes more than the complementary concave portion 263 on the inner side of the notch complementing section 249. The complementary convex portion 261 is continuous with the complementary concave portion 263 via an oblique complementary step portion 265.

The flange forming body 251 has a cylindrical section 267 and the second flange section 219 that is provided on a −Z side end portion of the cylindrical section 267. The cylindrical section 267 has a substantially cylindrical shape in which the +Z side is closed. Into the cylindrical section 267, the rod forming body 247 is inserted from the −Z side such that the +Z side of the rod forming body 247 is slidably held with respect to the cylindrical section 267. In other words, the flange forming body 251 can move in the extending direction of the winding core section 213 with respect to the rod forming body 247.

From the inner surface of a wall section of the cylindrical section 267 on the +Z side, a rod covering portion 269 and a tape holding protrusion 271 protrude toward the −Z side.

The rod covering portion 269 covers the outer circumferential surface of the +Z side end portion of the rod section 255. On a −Z side end portion of the rod covering portion 269, a switching regulating section 273 is provided. The switching regulating section 273, which will be described in detail below, regulates the notch complementing section 249 so as not to be switched from the contact position to the separated position. The tape holding protrusion 271 is inserted into the tape insertion section 231 in the winding body 209 from the +Z side when the winding attachment body 211 is attached to the winding body 209.

On the outer circumferential surfaces of the cylindrical section 267, two lever supporting sections 275 are provided. The two lever supporting sections 275 are disposed to correspond to the two engagement-section formed surfaces 233, which are provided on the winding core section 213. The lever supporting sections 275 pivotably supports the levers 253 respectively.

Figure 13:
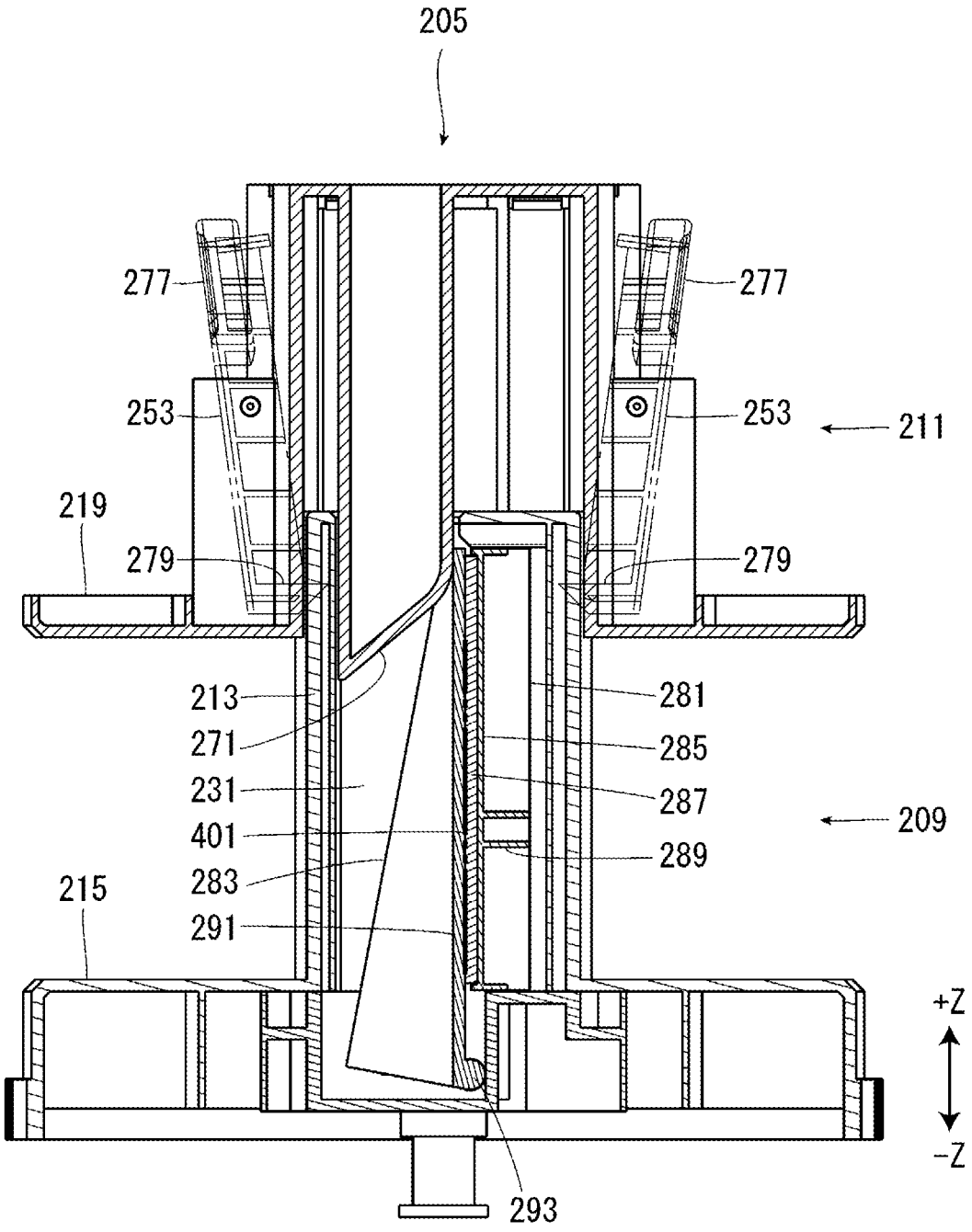
FIG. 13 is a cross-sectional view illustrating the winding body and the winding attachment section in which a tape holding section is located to a holding position before winding is started.

Each of the levers 253 is pivotably supported by the lever supporting section 275 around a substantially middle position in the extending direction of the winding core section 213. On a +Z side end portion of the lever 253, a finger placing section 277 is provided and on an inner side of a −Z side end portion of the lever 253, the lever-side engagement section 279, see FIG. 13, is provided. To the lever 253, by a lever spring that is not illustrated, a force is applied in a direction the lever-side engagement section 279 engages with the core-side engagement section 237. The lever spring may be, for example, a torsion coil spring that is provided to the pivot of the lever 253. When the user operates the finger placing sections 277 of the two levers 253 in the directions to approach each other, the lever-side engagement sections 279 are disengaged from the core-side engagement sections 237 and the flange forming body 251 is allowed to move toward the winding core section 213. On the other hand, when the user releases the fingers from the two levers 253, the lever-side engagement sections 279 engage with the core-side engagement sections 237 and the flange forming body 251 is fixed to the winding core section 213.

It is noted that a flange-lifting spring that is not illustrated is provided between the rod section 255 and the cylindrical section 267. The flange-lifting spring may be, for example, a compression coil spring. The flange-lifting spring applies a force to the rod forming body 247 and the flange forming body 251 in directions to separate from each other along the extending direction of the winding core section 213. Accordingly, even if the user releases the levers 253 at positions where the flange forming body 251 has been moved to the −Z side from the positions at which the lever-side engagement sections 279 engage with the core-side engagement sections 237, by the flange-lifting spring, the flange forming body 251 can be moved to the +Z side to the positions lever-side engagement sections 279 engage with the core-side engagement sections 237. With this structure, the tape 401 is prevented from being deformed in the width direction.

Notch Complementing Section

Figure 10:
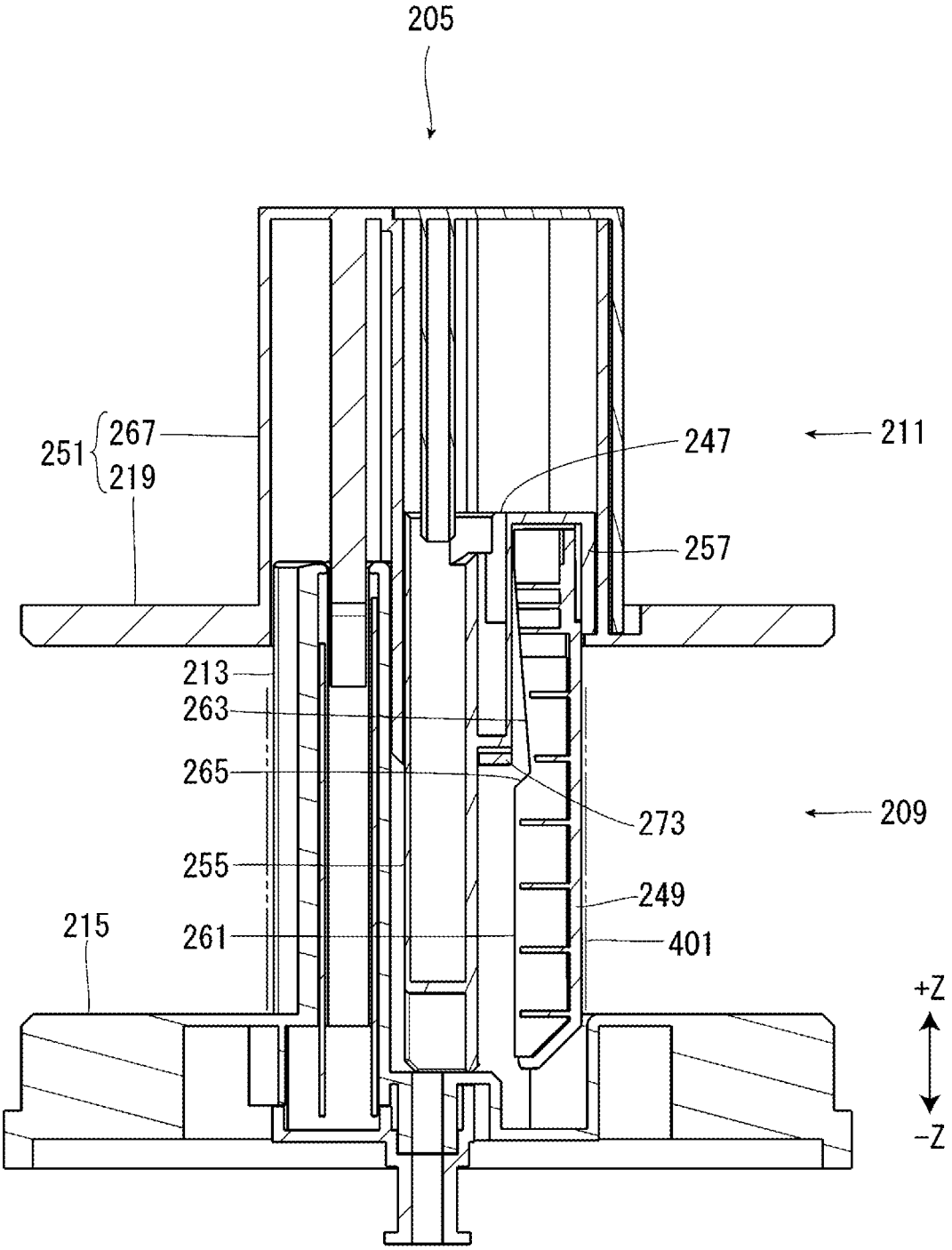
FIG. 10 is a cross-sectional view illustrating the winding body and the winding attachment section in which, from the state in FIG. 9, the rod section is inserted into the rod insertion section and a notch complementing section is allowed to move to a separated position before winding is started.

With reference to FIGS. 9 to 12, the notch complementing section 249 will be described. FIG. 9 and FIG. 10 illustrate the attachment of the winding attachment body 211 to the winding body 209. The drawings show before and after the insertion of the rod section 255 of the winding attachment body 211 into the rod insertion section 227 of the winding core section 213. As illustrated in FIG. 10, at the time the rod section 255 is inserted into the rod insertion section 227, the second flange section 219 is in a non-guide position away from the tape 401 than a guide position for guiding the widest tape 401. Specifically, although not illustrated in FIG. 10, the lever-side engagement section 279 is closer to the +Z side than the core-side engagement section 237 that is closest to the +Z side. In this state, the notch complementing section 249 is located to the contact position by the complementary spring. Even if the notch complementing section 249 is in the separated position, as will be described below, while the flange forming body 251 is moved toward the −Z side, the switching regulating section 273 comes into contact with the complementary step portion 265 of the notch complementing section 249 and the notch complementing section 249 is switched from the separated position to the contact position.

The switching regulating section 273, which is provided in the flange forming body 251, is located in a position corresponding to the complementary concave portion 263 of the notch complementing section 249 in the extending direction of the winding core section 213. Consequently, the notch complementing section 249 is allowed to be switched from the contact position to the separated position.

Figure 11:
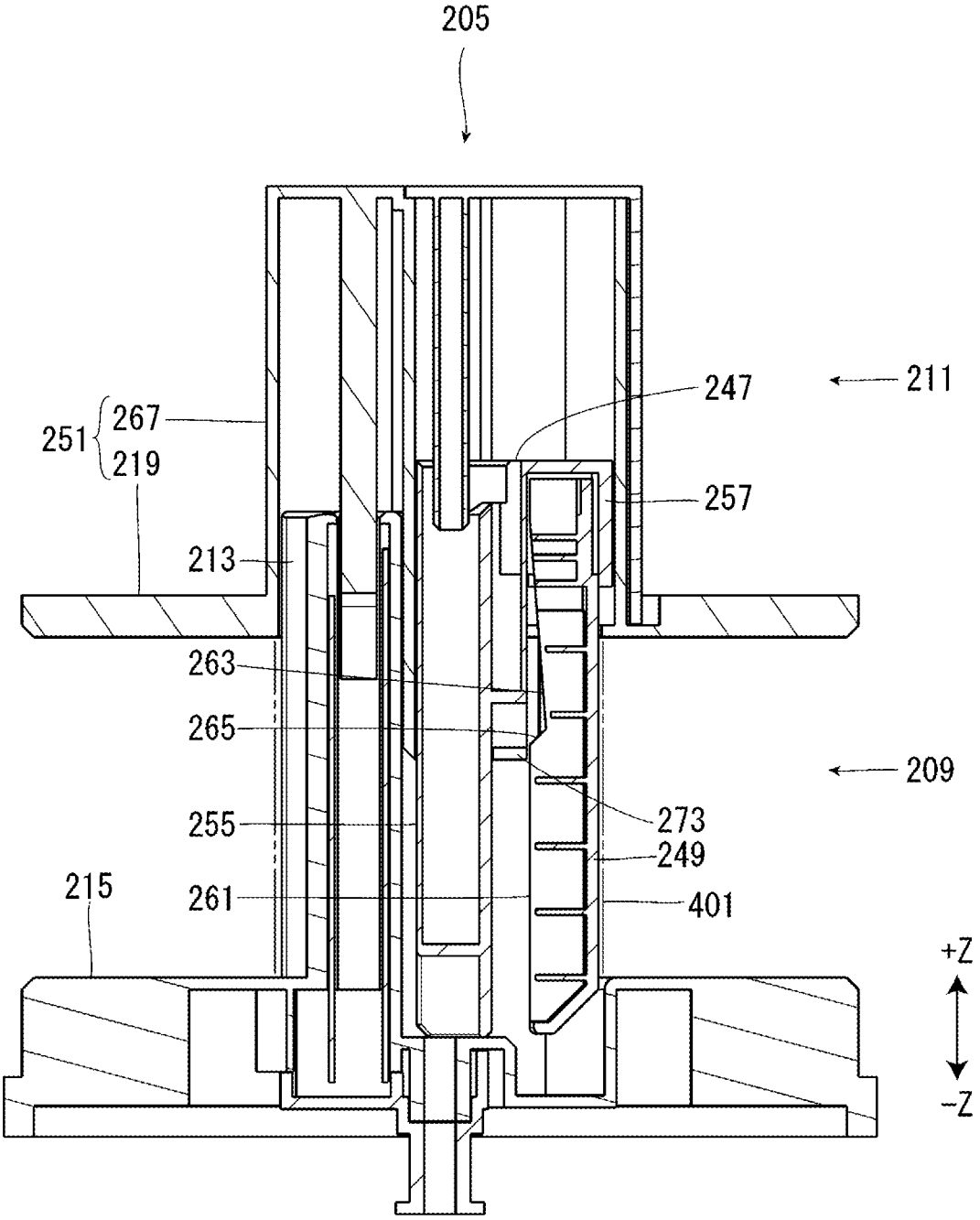
FIG. 11 is a cross-sectional view illustrating the winding body and the winding attachment section in which, from the state in FIG. 10, the notch complementing section is regulated so as not to move to the separated position before winding is started.

FIG. 11 illustrates the flange forming body 251 after the insertion of the rod section 255. The flange forming body 251 has been moved by the user toward the −Z side with respect to the rod forming body 247 such that the second flange section 219 is positioned to a guide position for guiding the widest tape 401. Specifically, although not illustrated in FIG. 11, the lever-side engagement section 279 is engaged with the core-side engagement section 237 that is located to the position closest to the +Z side. The switching regulating section 273, which is provided in the flange forming body 251, is moved together with the second flange section 219 and with respect to the rod forming body 247, and is located in a position corresponding to the complementary convex portion 261 of the notch complementing section 249 in the extending direction of the winding core section 213. Consequently, the notch complementing section 249 is regulated by the switching regulating section 273 so as not to be switched from the contact position to the separated position. In other words, while the notch complementing section 249 is moving from the contact position to the separated position, the complementary convex portion 261 comes into contact with the switching regulating section 273 in the moving operation, thereby the notch complementing section 249 is regulated so as not to be switched to the separated position. It is noted that while the notch complementing section 249 is in the contact position, the complementary convex portion 261 may be in contact with the switching regulating section 273 or may not be in contact with the switching regulating section 273.

As described above, while the second flange section 219 is in the guide position, the notch complementing section 249 is regulated so as not to be switched to the separated position. Accordingly, even if the winding force of the tape 401 that has been wound around the winding core section 213 acts on the notch complementing section 249, the notch complementing section 249 is not switched from the contact position to the separated position and remains in the contact position. Consequently, during the winding operation, the circular shape of the circumferential surface of the winding core section 213 can be maintained by the notch complementing section 249, thereby winding can be stably performed.

Figure 12:
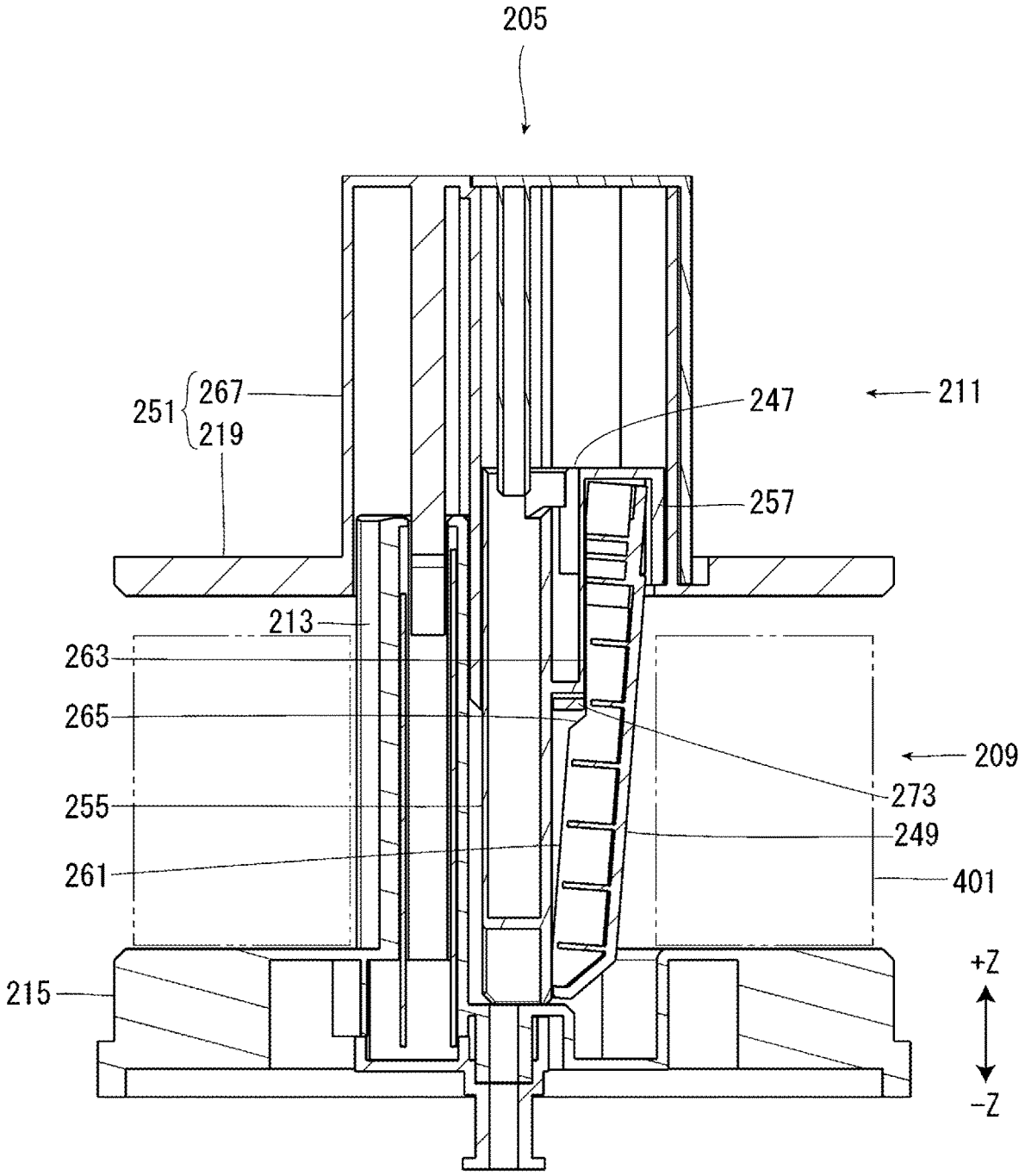
FIG. 12 is a cross-sectional view illustrating the winding body and the winding attachment section in which, from the state in FIG. 11, the notch complementing section has been moved to the separated position after winding is finished.

FIG. 12 illustrates the flange forming body 251 after the completion of winding of the tape 401. In detaching the winding attachment body 211 from the winding body 209, the user has moved the flange forming body 251 to the +Z side with respect to the rod forming body 247 such that the second flange section 219 is positioned to the non-guide position. Specifically, although not illustrated in FIG. 12, the lever-side engagement section 279 is closer to the +Z side than the core-side engagement section 237 that is located in the position closest to the +Z side. The switching regulating section 273, which is provided in the flange forming body 251, is moved together with the second flange section 219 with respect to the rod forming body 247, and is located in a position corresponding to the complementary concave portion 263 of the notch complementing section 249 in the extending direction of the winding core section 213. Consequently, the notch complementing section 249 is allowed to be switched from the contact position to the separated position. Specifically, while the notch complementing section 249 is moving from the contact position to the separated position, the complementary concave portion 263 is prevented from coming into contact with the switching regulating section 273 in the moving operation.

As described above, while the second flange section 219 is in the non-guide position, the notch complementing section 249 is allowed to be switched to the separated position. Accordingly, if the winding force of the tape 401 wound around the winding core section 213 acts on the notch complementing section 249, the notch complementing section 249 is moved from the contact position to the separated position. Consequently, after the completion of winding operation, a space is formed between the tape 401 that has been wound around the winding core section 213 and the notch complementing section 249, and the winding attachment body 211 can be readily removed from the winding body 209. It is noted that when the notch complementing section 249 is moved to the separated position, the complementary concave portion 263 may be in contact with the switching regulating section 273 or may not be in contact with the switching regulating section 273.

After the winding attachment body 211 is detached from the winding body 209, the notch complementing section 249 is pulled out from the notched section 229, and the notched section 229 is exposed. Accordingly, the user can put fingers into the notched section 229 and hold the tape 401 that has been wound around the winding core section 213, and can readily remove the tape 401 from the winding core section 213. Although the winding of the widest tape 401 has been described, the same applies to winding of the tapes 401 of other widths.

Tape Insertion Section

Figure 14:
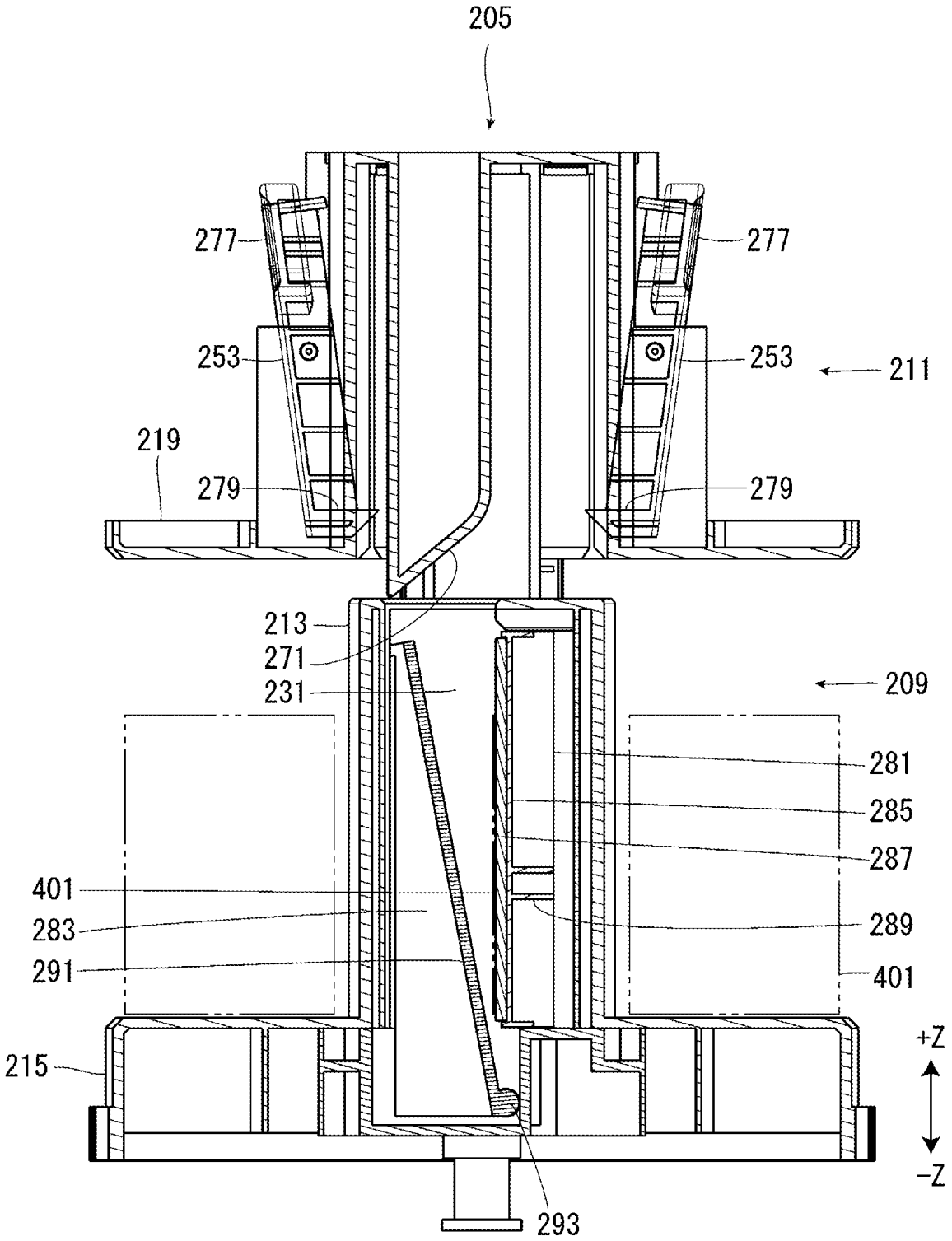
FIG. 14 is a cross-sectional view illustrating the winding body and the winding attachment section in which, from the state in FIG. 13, the tape holding section has been located to a non-holding position after winding is finished.

With reference to FIG. 13 and FIG. 14, the tape insertion section 231 will be described. The tape insertion section 231 includes a tape receiving section 281 and a tape holding section 283 along the longitudinal direction of the tape insertion section 231. The tape receiving section 281 has a substantially rectangular parallelepiped shape with an open surface on the opposite side of the tape holding section 283 side. The tape receiving section 281 can move with respect to the winding body 209 in the longitudinal direction of the tape insertion section 231.

The tape receiving section 281 has a receiving wall section 285 that is provided on the tape holding section 283 side. The receiving wall section 285 extends in the extending direction of the winding core section 213. A receiving member 287 is fixed to a surface of the receiving wall section 285 on the tape holding section 283 side. It is preferable that the receiving member 287 be made of a material having a high coefficient of friction such as silicone rubber. Instead of the receiving wall section 285, the receiving member 287 may be provided on a pressure wall section 291 of the tape holding section 283, which will be described below, or may be provided on both the receiving wall section 285 and the pressure wall section 291. A spring attachment boss 289 protrudes from a surface of the receiving wall section 285 on the opposite side of the tape holding section 283 side. To the spring attachment boss 289, a tape receiving spring is attached. The tape receiving spring is provided between the receiving wall section 285 and the winding core section 213 and applies force to the tape receiving section 281 toward the tape holding section 283 side. The tape receiving section 281 is an example "medium receiving unit" according to the invention.

The tape holding section 283 has a substantially right triangular prism shape with an open surface on the opposite side of the tape receiving section 281 side as viewed in the short side direction of the tape insertion section 231. The tape holding section 283 has the pressure wall section 291 that is provided on the tape receiving section 281 side. On an end portion of the tape holding section 283 on the −Z side and on the tape receiving section 281 side, a holding shaft section 293 is provided. The holding shaft section 293 is located on the −Z side of the receiving wall section 285 and extends in the short side direction of the tape receiving section 281. The tape holding section 283 is attached to the winding body 209 so as to be able to pivot about the holding shaft section 293. Specifically, the pressure wall section 291 of the tape holding section 283 is substantially parallel to the extending direction of the winding core section 213. The tape holding section 283 can pivot between a holding position, see FIG. 13, for holding the tape 401 against the tape receiving section 281 and a non-holding position, see FIG. 14, in which the pressure wall section 291 is inclined with respect to the extending direction of the winding core section 213 and is separated from the receiving member 287 more than the holding position. The tape holding section 283 is an example "medium holding unit" according to the invention.

The tape holding protrusion 271 that is inserted into the tape insertion section 231 from the +Z side is inserted into the tape insertion section 231 from the +Z side as described above when the winding attachment body 211 is attached to the winding body 209. The tape holding protrusion 271 is pulled out from the tape insertion section 231 toward the +Z side when the winding attachment body 211 is detached from the winding body 209. An end portion of the tape holding protrusion 271 has an oblique shape in which the tape holding section 283 side is the −Z side and the tape receiving section 281 side is the +Z side. The tape holding protrusion 271 is an example "holding operation unit" according to the invention.

FIG. 13 illustrates the winding attachment body 211 attached to the winding body 209 before winding is started. When the winding attachment body 211 is attached to the winding body 209, the tape holding protrusion 271 is inserted into the tape insertion section 231 from the +Z side, and a +Z side end portion of the tape holding section 283 engages with the end portion of the inserted tape holding protrusion 271. As the tape holding protrusion 271 is further moved toward the −Z side, the tape holding protrusion 271 presses the tape holding section 283 and the tape holding section 283 pivots from the non-holding position to the holding position. With this operation, the tape holding section 283 presses the tape receiving section 281 against the tape receiving spring, and holds the end portion of the tape 401 with the tape receiving section 281 therebetween. Accordingly, the end portion of the tape 401 is fixed to the winding core section 213.

As described above, when the winding attachment body 211 is attached to the winding body 209, that is, when the second flange section 219 is attached to the winding core section 213, the tape holding section 283 is moved to the holding position, fixing the end portion of the tape 401 to the winding core section 213. Accordingly, the end portion of the tape 401 can be fixed to the winding core section 213 before starting winding without using an adhesive tape, or the like.

FIG. 14 illustrates the winding body 209 from which the winding attachment body 211 is detached after winding of the tape 401 is finished. In this state, the tape holding protrusion 271 is pulled out from the tape insertion section 231, and the tape holding section 283 returns to the non-holding position by its own weight. This operation releases the end portion of the tape 401 that is fixed to the winding core section 213. It is noted that a torsion coil spring may be added to the holding shaft section 293 such that in pulling out the tape holding protrusion 271 from the tape insertion section 231, the tape holding section 283 returns to the non-holding position due to the resilience of the torsion coil spring.

As described above, when the winding attachment body 211 is detached from the winding body 209, that is, when the second flange section 219 is detached from the winding core section 213, the tape holding section 283 is switched to the non-holding position, releasing the fixing of the end portion of the tape 401 to the winding core section 213. Accordingly, after the completion of winding, the tape 401 that has been wound around the winding core section 213 can be readily removed from the winding core section 213.

As described above, the winding apparatus 201 according to the embodiment includes the winding core section 213 and the notch complementing section 249. Onto the winding core section 213, the tape 401 is wound. The winding core section 213 has the notched section 229 having the shape in which a part of the winding core section 213 in the circumferential direction is cut out as viewed in the extending direction of the winding core section 213. The notch complementing section 249 is detacheably inserted into the notched section 229 from the +Z side to complement the notched section 229.

With this structure, during the winding operation, the circular shape of the circumferential surface of the winding core section 213 can be maintained by the notch complementing section 249, thereby winding can be stably performed. Furthermore, after the completion of winding, by pulling out the notch complementing section 249 from the notched section 229, the user can put fingers into the notched section 229 and hold the tape 401 that has been wound around the winding core section 213. Accordingly, the user can readily remove the tape 401 from the winding core section 213.

Modifications

It is to be understood that the invention is not limited to the above-described embodiment, various modifications can be made without departing from the scope of the invention. For example, in addition to the above-described embodiment, the embodiment may be modified as described below.

The "continuous medium" according to the invention is not limited to the tape-shaped continuous medium such as the tape 401, and for example, the "continuous medium" may be roll paper. The length, width, and material of the "continuous medium" are also not particularly limited.

The "notch complementing unit" according to the invention is not limited to the structure for complementing a part of the notched section 229 in the circumferential direction of the winding core section 213, such as the notch complementing section 249. For example, the "notch complementing unit" may be a structure that complements the entire notched section 229.

The "notch complementing unit" according to the invention is not limited to the structure that is attached to the winding attachment body 211, such as the notch complementing section 249. For example, "notch complementing unit" may be a component provided separately from the winding attachment body 211. Furthermore, except the "notch complementing unit" the winding attachment body 211 may be omitted.

The "notch complementing unit" according to the invention is not limited to the structure in which the "notch complementing unit" pivots between the contact position and the separated position, such as the notch complementing section 249. For example, the "notch complementing unit" may be a component that parallelly moves between the contact position and the separated position. Similarly, the "medium holding unit" according to the invention is not limited to the structure in which the "medium holding unit" pivots between the holding position and the non-holding position, such as the tape holding section 283. For example, the "medium holding unit" may be a component that parallelly moves between the holding position and the non-olding position.

To the tape printing apparatus 101 according to the embodiment, a "printing apparatus" according to the invention may be applied. Specifically, the tape printing apparatus 101 may include components similar to those in the winding core section 213 and the notch complementing section 249 according to the embodiment. In other words, the tape printing apparatus 101 and the winding apparatus 201 may be integrally provided. The "printing apparatus" according to the embodiment of the invention is not limited to the structure for performing printing onto a tape-shaped medium. For example, "printing apparatus" may perform printing onto roll paper. The "printing unit" according to the embodiment of the invention is not limited to the structure for printing by a thermal method, such as the thermal head. For example, "printing unit" may be a structure for printing by an ink jet method, an electrophotographic method, or a dot impact method.

The entire disclosure of Japanese Patent Application No. 2018-066430, filed Mar. 30, 2018 is expressly incorporated by reference herein.

What is claimed is:

1. A winding apparatus comprising:

a winding core unit onto which a continuous medium is to be wound, the winding core unit having a notched portion having a shape in which a part of the winding core unit in a circumferential direction is cut out as viewed in an extending direction of the winding core unit; and a notch complementing unit to be detacheably inserted into the notched portion from one end portion side in the extending direction of the winding core unit, the notch complementing unit being configured to complement the notched portion.

2. The winding apparatus according to claim 1, wherein when the notch complementing unit is inserted into the notched portion, the notch complementing unit is switched between a contact position in which the notch complementing unit comes into contact with the continuous medium wound around the winding core unit and a separated position in which the notch complementing unit is separated from the continuous medium radially inward toward the winding core unit.

3. The winding apparatus according to claim 2, further comprising:

a flange forming unit configured to move in the extending direction of the winding core unit, wherein the flange forming unit includes:

a flange unit configured to move in the extending direction of the winding core unit between a guide position for guiding the continuous medium by guiding the continuous medium to be wound around the winding core unit in a width direction of the continuous medium, and a non-guide position away from the position at which the continuous medium is wound around the winding core unit than the guide position; and a switching regulating unit configured to move together with the flange unit, and when the flange unit is in the guide position, regulate the notch complementing unit so as not to be switched from the contact position to the separated position and when the flange unit is in the non-guide position, allow the notch complementing unit to be switched from the contact position to the separated position.

4. The winding apparatus according to claim 3, wherein the winding core unit includes:

a medium insertion unit into which an end portion of the continuous medium is to be inserted;

a medium receiving unit disposed in the medium insertion unit; and a medium holding unit disposed in the medium insertion unit, the medium holding unit being configured to be switched between a holding position for holding the continuous medium inserted into the medium insertion unit against the medium receiving unit and a non-holding position away from the medium receiving unit more than the holding position, and the flange unit includes:

a holding operation unit detachably attached to the winding core unit, and when the flange unit is attached to the winding core unit, causes the medium holding unit to be located in the holding position, and when the flange unit is detached from the winding core unit, causes the medium holding unit to be located in the non-holding position.

5. A printing apparatus comprising:

a printing unit configured to perform printing onto a continuous medium;

a winding core unit onto which the continuous medium is to be wound, the winding core unit having a notched portion having a shape in which a part of the winding core unit in a circumferential direction is cut out as viewed in an extending direction of the winding core unit; and a notch complementing unit to be detacheably inserted into the notched portion from one end portion side in the extending direction of the winding core unit, the notch complementing unit being configured to complement the notched portion.

* * * * *